US007470347B2

(12) United States Patent
Jansson et al.

(10) Patent No.: US 7,470,347 B2
(45) Date of Patent: Dec. 30, 2008

(54) DEVICE AND METHOD WITHDRAWING CELLULOSE PULP FROM A CONTAINER

(75) Inventors: Ulf Jansson, Karlstad (SE); Jonas Bjorkstrom, Karlstad (SE)

(73) Assignee: GLV Finance Hungary Kft., Luxembourg Branch, Luxembourg (LU)

( * ) Notice: Subject to any disclaimer, the term of this patent is extended or adjusted under 35 U.S.C. 154(b) by 388 days.

(21) Appl. No.: 10/596,075

(22) PCT Filed: Dec. 13, 2004

(86) PCT No.: PCT/SE2004/001849

§ 371 (c)(1), (2), (4) Date: May 27, 2006

(87) PCT Pub. No.: WO2005/061781

PCT Pub. Date: Jul. 7, 2005

(65) Prior Publication Data

US 2007/0151693 A1 Jul. 5, 2007

(30) Foreign Application Priority Data

Dec. 23, 2003 (SE) ..... 0303592

(51) Int. Cl.
*D21C 7/06* (2006.01)

(52) U.S. Cl. ..... 162/246; 137/590; 137/577.5

(58) Field of Classification Search ..... 162/246; 137/590, 577.5

See application file for complete search history.

(56) References Cited

U.S. PATENT DOCUMENTS 3,587,637 A * 6/1971 Coleman ..... 137/577.5
5,319,902 A * 6/1994 Seppa ..... 52/741.1
5,538,597 A * 7/1996 Koso et al. ..... 162/246

* cited by examiner

*Primary Examiner*—Mark Halpern

(57) ABSTRACT

This is a device and a method for withdrawing cellulose pulp with a pulp concentration of 8-14% from a cylindrical storage tower. The storage tower has a plane bottom and with a diameter that exceeds 3 meters. A pipe is arranged through the wall of the storage tower that is parallel to the bottom of the tower and directed towards the center of the tower. The pipe has at one of its ends an obliquely cut opening that faces upwards in the tower. The pipe is attached at its other end to an MC pump to be able to pump out cellulose pulp from the storage tower.

7 Claims, 1 Drawing Sheet

DEVICE AND METHOD WITHDRAWING CELLULOSE PULP FROM A CONTAINER

PRIOR APPLICATION

This application is a U.S. national phase application based on International Application No. PCT/SE2004/001849, filed 13 Dec. 2004, claiming priority from Swedish Patent Application No. 0303592-0, filed 23 Dec. 2003.

TECHNICAL AREA

The present invention concerns a method and a device for withdrawing cellulose pulp of medium consistency from the bottom of a storage tower with a diameter that exceeds 3 meters at the bottom of the tower.

THE PRIOR ART

The use of storage towers in pulp mills for the storage of cellulose pulp with a low consistency with a pulp concentration of approximately 3-5% is known. These storage towers are usually constructed from cement with a plane bottom, and they have a diameter at the bottom of the tower of approximately 3-4 meters, or greater. What are known as "bottle towers" are often used. These towers have a larger diameter at a distance from the bottom of the tower, with a convergent section between the upper part and the lower part of the tower. "Storage tower" is here used to denote a tower in which the pulp has a significant retention time, and it denotes the possibility that chemicals may have been added to the pulp in the tower.

The low consistency pulp is normally withdrawn from the tower through an outlet spigot through the wall close to the bottom of the container, where it is possible to arrange one or several propeller stirrers at the bottom of the tower in order to maintain circulation in the pulp.

Ever-smaller amounts of low consistency pulp are now being used in processes during the production of pulp: it is being replaced by pulp of medium consistency, having a pulp concentration of 8-14%. The handling of pulp at medium consistency reduces the amounts of water that must be transported through the system and contributes to a reduction in the power consumed (by pumps) and the amount of contaminated filtrate water.

Conventional storage towers for medium consistency require a different design at the bottom, usually with a concave bottom end, and of associated bottom scrapers, in order to make it possible to withdraw cellulose pulp of medium consistency from the tower.

This has led to the storage towers for low consistency pulp either standing unused and occupying space at the mill, or requiring extensive rebuilding. Cement towers with a plane bottom often stand directly on the floor of the factory and this makes it impossible to install bottom scrapers.

AIM AND PURPOSE OF THE INVENTION

The principal aim of the present invention is to exploit the empty storage towers that were originally intended for the storage of cellulose pulp with low consistency such that they are used for the storage of cellulose pulp of medium consistency, instead.

DETAILED DESCRIPTION OF THE INVENTION

Figure 1:
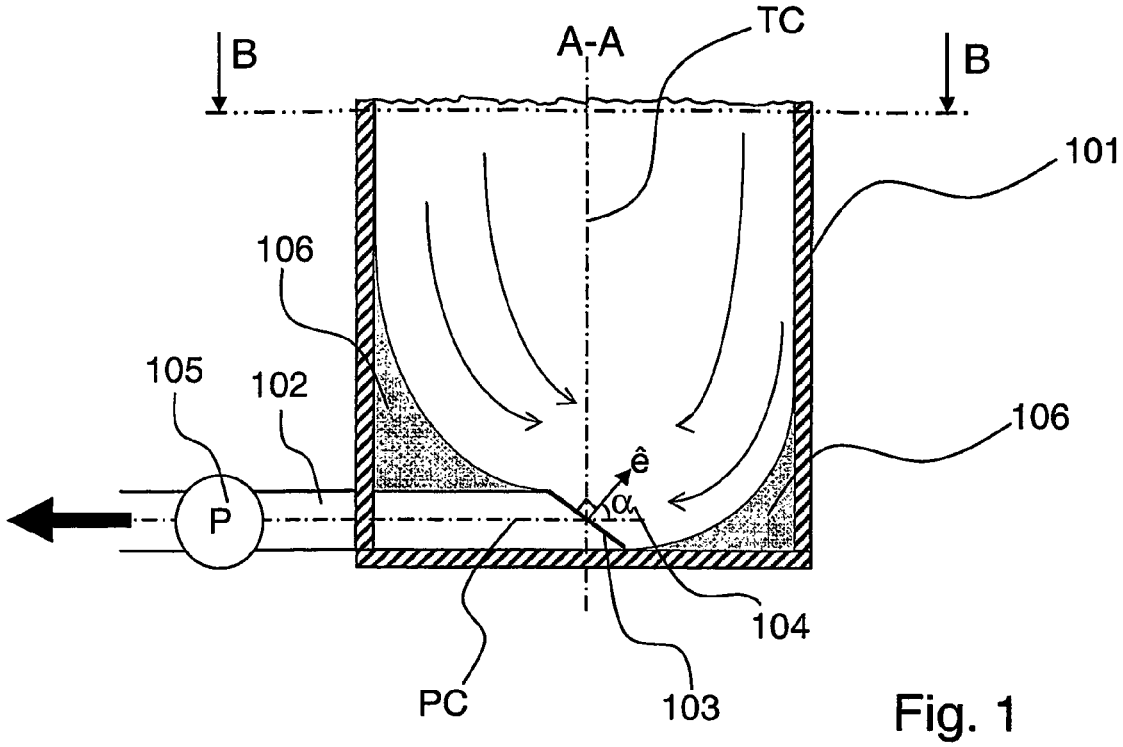
FIG. 1 shows in side elevation a cross-section of the lower part of a storage tower in which the invention is included. The figure also makes clear how the pulp of medium consistency moves within the storage tower.
Figure 2:
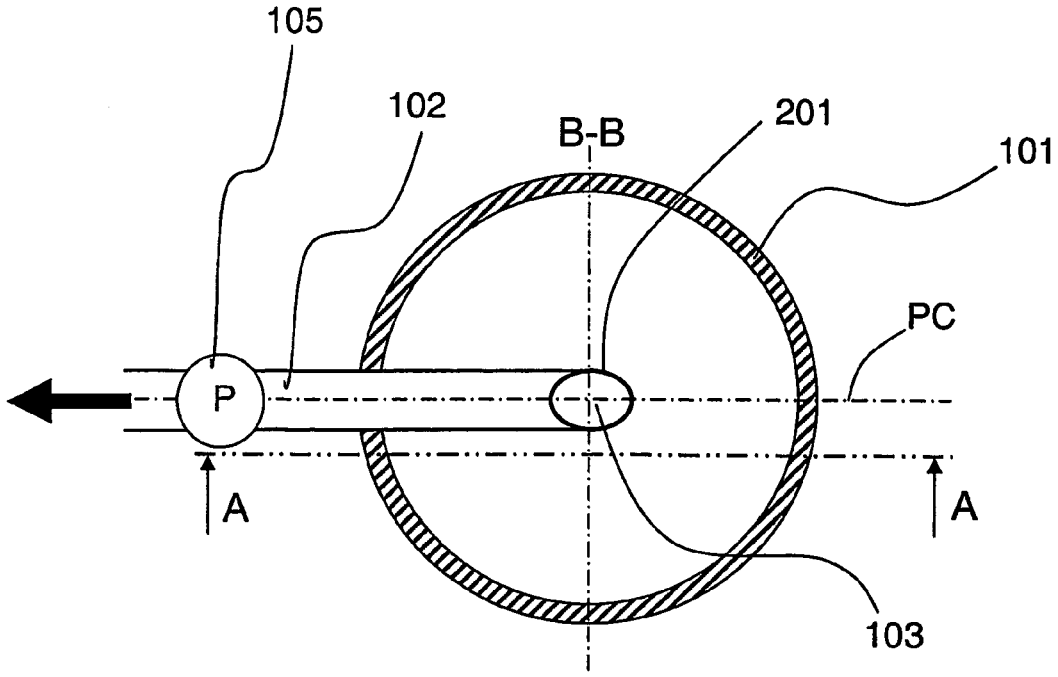
FIG. 2 shows a plan of a cross-section of the lower part of a storage tower in which the invention is included.

FIG. 1 and FIG. 2 show preferred embodiments in the form of a device and a method for the withdrawing of cellulose pulp from a storage tower 101. The cellulose pulp is of medium consistency with a pulp concentration of 8-14%, preferably 8-11%.

The storage tower 101 has walls and a plane bottom, preferably of cement poured on site, with a principally cylindrical design and with an inner diameter of the bottom of the tower that exceeds 3 meters.

A pipe 102 with a diameter that exceeds 0.4 meters, preferably one that exceeds 0.6 meters, is arranged according to the invention at the bottom part of the storage tower 101, through the wall of the storage tower just above the bottom of the tower. The pipe 102 is essentially parallel with the bottom of the tower and it is directed towards the centre of the tower. The pipe is located at a distance from the bottom of the tower that is smaller than the diameter of the pipe. The pipe 102 has an opening 103 that is obliquely cut and that faces upwards. The angle 104 of opening of the pipe lies between 40° and 80°, preferably between 60° and 70°. "Angle 104 of opening" is here used to denote the angle between the central axis of the pipe 102 and the perpendicular to the plane that is defined by the edges of the pipe and the obliquely cut opening 103. The perpendicular to the plane of opening is denoted in FIG. 1 by "ê". The insertion of the pipe in the tower towards the centre extends sufficiently far such that the edges of the obliquely cut opening of the pipe surround the centre of the tower, whereby the opening in the tube coincides in one part with the centre of the tower 101.

At least one MC pump 105 is connected to the pipe externally to the tower with the aim of pumping out the pulp of medium consistency from the storage tower 101.

Pulp of medium consistency has a much higher viscosity and it flows significantly more sluggishly than pulp of low consistency, for which the storage tower 101 was originally constructed. Pulp of medium consistency cannot, for this reason, be withdrawn from the tower through an outlet spigot in a manner equivalent to that used for pulp of low consistency, since serious channel formation would in this case take place in the bed of pulp. This problem is avoided by withdrawing instead the pulp from the centre of the storage tower 101, close to the bottom, through the opening 103 of the pipe 102. However, the pulp around and in the vicinity of the opening 103 will become more stationary, in what are known as "zones of stagnation" 106. These zones of stagnation 106, however, help the more mobile pulp at the centre to move towards the opening 103.

The major advantage of the invention is that it is possible to use existing storage towers 101 with a plane bottom that are intended for pulp with low consistency also with pulp of medium consistency.

The present invention is not limited to the embodiments that have been shown, and several variations are possible within the framework of the patent claims.

While the present invention has been described in accordance with preferred compositions and embodiments, it is to be understood that certain substitutions and alterations may be made thereto without departing from the spirit and scope of the following claims.

The invention claimed is:

1. A device for withdrawing cellulose pulp from a cylindrical storage tower, comprising: the storage tower having an essentially plane bottom with a diameter at the plane bottom of the storage tower that exceeds 3 meters, which cellulose pulp is of medium consistency, having a pulp concentration of 8-14%, a pipe arranged through a wall of the storage tower, the pipe being parallel to the plane bottom of the storage tower and directed towards a center of the storage tower, the pipe having at one end an obliquely cut opening defined therein that faces upwardly in the storage tower, edges of the obliquely cut opening of the pipe surrounding the center of the storage tower, the obliquely cut opening of the pipe coinciding in one part with the center of the storage tower and the pipe being attached, at a second end of the pipe, externally to the storage tower, to an MC pump to pump out the cellulose pulp from the storage tower.

2. The device according to claim 1, wherein the pipe has a diameter that exceeds 0.4 meters.

3. The device according to claim 1, wherein the obliquely cut opening has an angle of opening that is between 40° and 80°.

4. The device according to claim 1 wherein the pipe is parallel with the plane bottom of the storage tower at a distance that is smaller than the diameter of the pipe.

5. A method for withdrawing cellulose pulp from a cylindrical storage tower, comprising: providing the storage tower with an essentially plane bottom with a diameter at the plane bottom of the storage tower that exceeds 3 meters, providing cellulose pulp being of medium consistency having a pulp concentration of 8-14% providing a pipe with a diameter that exceeds 0.4 meters arranging the pipe through a wall of the storage tower so that the pipe is arranged parallel to the plane bottom of the storage tower and directed towards a center of the storage tower, the pipe having at one end an obliquely cut opening defined therein that faces upwardly in the storage tower, edges of the obliquely cut opening of the pipe surrounding the center of the storage tower, the obliquely cut opening of the pipe coinciding in one part with the center of the storage tower and attaching the pipe at a second end of the pipe externally to the storage tower to an MC pump, and pumping out the cellulose pulp from the storage tower.

6. The method according to claim 5, the method further comprises providing the obliquely cut opening with an angle of opening that is between 40° and 80°.

7. The method according to claim 5 wherein the pipe is parallel to the plane bottom of the storage tower at a distance that is less than a diameter of the pipe.

* * * * *